US005575011A

United States Patent [19]

Allen

[11] Patent Number: 5,575,011

[45] Date of Patent: Nov. 19, 1996

[54] DETACHABLE WAIST BAND EXTENDER AND GARMENT INCLUDING THE SAME

[76] Inventor: Todd M. Allen, 1362 S. Vineyard Apt. #2011, Mesa, Ariz. 85210

[21] Appl. No.: 551,739

[22] Filed: Nov. 1, 1995

[51] Int. Cl.[6] ..... A41D 1/06

[52] U.S. Cl. ..... 2/236; 2/221; 2/311

[58] Field of Search ..... 2/235, 236, 237, 2/311, 312, 336, 338, 219–221; 24/178, 322.1, 323

[56] References Cited

U.S. PATENT DOCUMENTS

| | | |
|---|---|---|
| 1,017,544 | 2/1912 | Hoffman . |
| 1,431,846 | 10/1922 | Slavens . |
| 2,625,688 | 1/1953 | Kaufman . |
| 4,580,298 | 4/1986 | Tuisl . |
| 4,803,740 | 2/1989 | Dawson . |

*Primary Examiner*—C. D. Crowder
*Assistant Examiner*—Gloria Hale
*Attorney, Agent, or Firm*—John D. Lister

[57] ABSTRACT

A detachable waist band extender enables an individual with a garment having a certain waist band dimension to wear the garment when the waist measurement of the individual exceeds the waist dimension of the garment. The waist band extender has a tab portion which is fastened to a button on a first side of a fly opening of the garment and a belt loop portion having a buckle at a first free end and a tongue at a second free end. The tongue of the belt loop portion is passed through a button hole in a second side of the fly opening and adjustably secured to the buckle to join the sides of the fly together. Since the tongue is adjustably secured to the buckle, the effective length of the waist band extender can be adjusted to accommodate the waist measurement of the wearer and later changed to accommodate any changes in the waist measurement of the wearer.

9 Claims, 1 Drawing Sheet

20
22
24
26
28
30
32
34
36
38
40
42
44

DETACHABLE WAIST BAND EXTENDER AND GARMENT INCLUDING THE SAME

BACKGROUND OF THE INVENTION

The present invention is directed to a waist band extender for extending the waist bands of lower body garments and, in particular, to a detachable waist band extender which can be easily applied to and removed from the waist band of a lower body garment and easily adjusted to accommodate changes in the waist measurement of the garment wearer.

When the waist measurement of an individual is temporarily greater than normal, such as during the early portion of a woman's pregnancy, immediately after a woman gives birth, or as a result of weight gains and fluctuations, an individual typically purchases larger size shorts, skirts, pants or other lower body garments to accommodate the increase in the individual's waist line. While the purchase of a such temporary wardrobe is a solution to the problem, it is an expensive and impractical solution to the problem.

Prior art efforts, known to the inventor, to alter the waist band of a lower body garment or otherwise accommodate changes in the waist line measurements of an individual, include the following:

U.S. Pat. No. 4,580,298, inventor Tuisl, issued Apr. 8, 1986, discloses a waist band extender with a band, having a button hole and button (FIG. 4) or male and female snap elements (FIG. 6), which bridges the fly opening of the garment to secure the waist band about the wearer. The extent that the garment waist band is lengthened by means of Tuisl's waist band extender is fixed by the spacing between the button hole and button or the snap elements of Tuisl's waist band extender.

U.S. Pat. No. 4,803,740, inventor Dawson, issued Feb. 14, 1989, discloses a waist band extender for a garment which includes a triangular panel, with a button hole and buttons and VELCRO-like fabric strips secured to both the panel and the garment, for bridging the fly opening of a garment to secure the waist band of the garment.

U.S. Pat. No. 1,017,544, inventor Hoffman, issued Feb. 13, 1912, discloses trousers with belt sections sewn thereon having button holes 10 which can be fastened to buttons 13 to put tucks in the waist band of the trousers and reduce the length of the waist band. U.S. Pat. No. 1,431,846, inventor Slavens, issued Oct. 10, 1922, discloses a belt with sections that can be added or removed to change the length of the belt. U.S. Pat. No. 2,625,688, inventor Kaufman, issued Jan. 20, 1953, discloses trousers with an elastic waist band 14 and belt sections 17 and 18 sewn to the elastic waist band.

It is an object of the present invention to provide an inexpensive, detachable waist band extender that can be readily secured to and removed from a variety of lower body garments without having to alter the garments.

It is a further object of the present invention to provide an inexpensive, detachable waist band extender which permits the waist band of the lower body garment to be quickly, easily and selectively extended to any one of numerous closely spaced settings whereby the waist band of the garment can be readily adapted to comfortably fit minor as well as major variations and fluctuations in the waist measurement of the wearer.

SUMMARY OF THE INVENTION

The detachable waist band extender of the present invention includes a tab portion with a button hole therein for easily and quickly securing the waist band extender to a button on one side of a fly opening of a lower body garment. The tab portion of the detachable waist band extender is integral with and extends outwardly from a belt loop portion of the waist band extender at a location intermediate the free ends of the belt loop portion. The belt loop portion has a buckle mechanism at one free end and a tongue prolongation at the other free end. The tongue has a width no greater than the largest dimension of the fly button hole of the lower body garment with which the detachable waist band extender is being used.

To secure the two sides of the fly opening of a lower body garment together, the tab of the detachable waist band extender is fastened to the button on one side of the fly opening and the tongue of the belt loop portion of the detachable waist band extender is passed through the button hole on the opposite side of the fly opening and secured to the buckle mechanism. By using a belt loop with a tongue and buckle mechanism, the tongue of the detachable waist band extender can be inserted into the buckle mechanism in varying degrees to closely, easily and quickly match the waist line measurement of the wearer and any fluctuations in the waist line measurement of the wearer.

In a preferred embodiment of the present invention, the tongue of the belt loop is provided with a series of closely spaced apertures, e.g. on half inch centers or less. Preferably, the series of apertures extends for substantially the entire length of the tongue. A prong of the buckle mechanism engages and passes through a selected aperture in the tongue to secure the free ends of the belt loop portion of the detachable waist band extender together and set the effective length that the waist band of the lower body garment is extended by the detachable waist band extender.

The detachable waist band extender of the present invention is preferably made of an inextensible or substantially inextensible material, such as leather.

DESCRIPTION OF THE PREFERRED EMBODIMENTS

Figures 1, 2, 3, 4, 5:
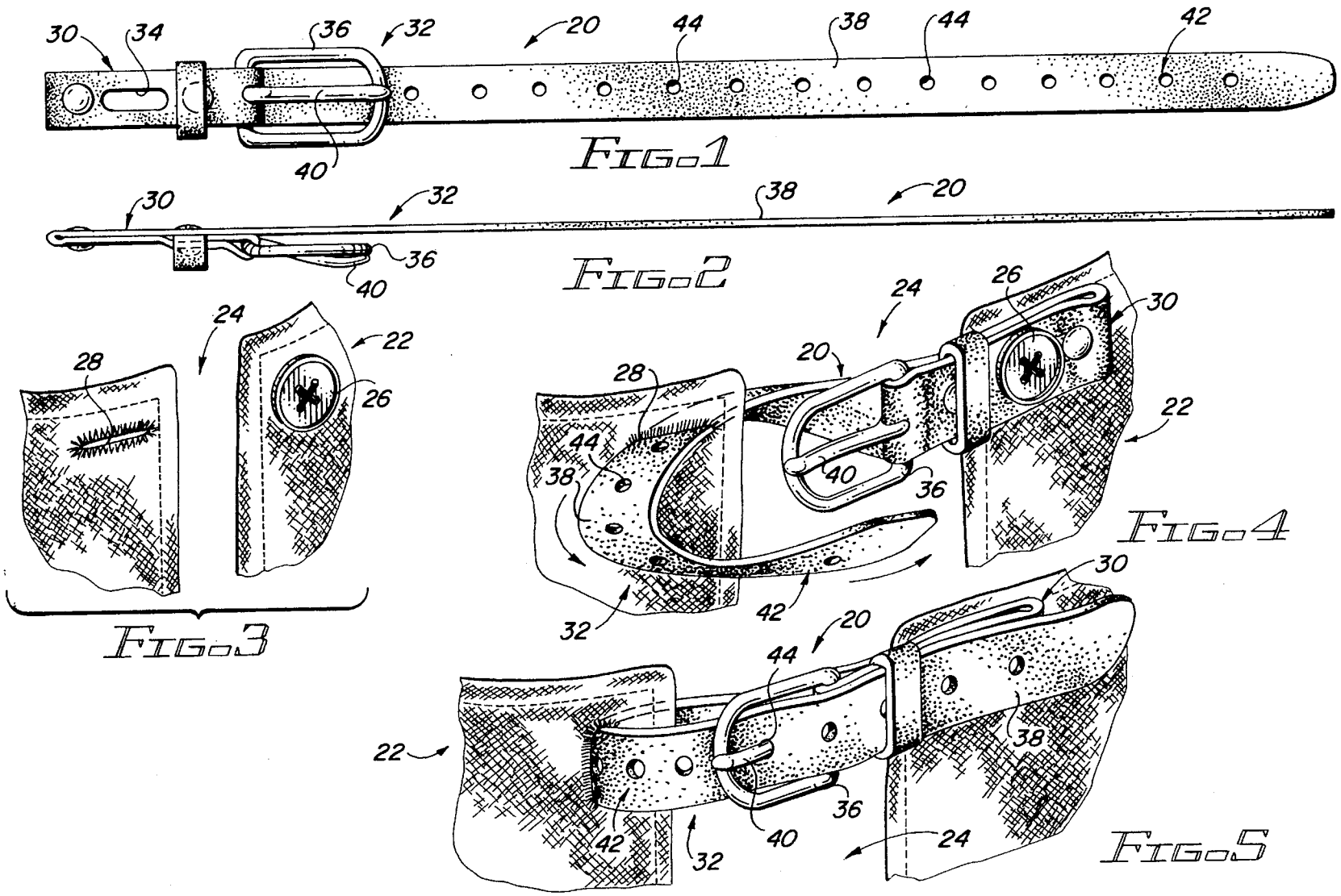
FIG. 1 is a front view of the detachable waist band extender of the present invention.
FIG. 2 is a top view of the detachable waist band extender of the present invention.
FIG. 3 is a partial perspective view of a lower body garment having a fly opening with which the detachable waist band extender of the present invention is to be used.
FIG. 4 is a partial perspective view of the garment of FIG. 3 with the detachable waist band extender secured to one side of the fly opening and in the process of being secured to the other side of the fly opening of the lower body garment.
FIG. 5 is a partial perspective view of the lower body garment of FIG. 3 with the detachable waist band extender secured to both sides of the fly opening.

FIGS. 1 and 2, show the detachable waist band extender 20 of the present invention. The detachable waist band extender 20 is used to extend the waist band of a lower body garment, such as the lower body garment 22 shown in FIG. 3, which has a fly opening 24 extending down from the upper edge of the garment's waist band. The fly opening 24 has a button 26 located on the waist band adjacent and on a first side of the fly opening 24 and a button hole 28, through which the button 26 is normally fastened to secure the top of the fly opening together at the waist band, located adjacent and on a second side of the fly openings 24. In addition, the fly opening 24 is typically provided with a series of fastener elements (not shown) such as a plurality of buttons and button holes, a plurality of male and female snaps, or zipper elements, which extend down opposite sides of the fly opening 24 to enable the fly opening to be opened and closed in normal use.

The detachable waist band extender 20 comprises a tab portion 30 and a belt loop portion 32. The tab portion 30 of the detachable waist band extender has a button hole 34 therein for receiving the button 26 on the waist band of the lower body garment 22. The belt loop portion 32 of the detachable waist band extender comprises a buckle mechanism 36 at a first free end of the belt loop portion and a tongue 38 at a second free end of the belt loop portion. The tongue 38 of the belt loop portion 32 has a width no greater than a largest dimension of the button hole 28 in the waist band of the lower body garment so that the tongue 38 can pass through the button hole 28. The tongue 38 of the detachable waist band extender is received within and secured by the buckle mechanism 36 of the detachable waist band extender to form a belt loop that can be varied in size to adjust the effective length of the detachable waist band extender 20 so that the waist band of the lower body garment 22 can be extended to the degree necessary to comfortably fit the wearer. Since the size of the belt loop formed can be easily and quickly adjusted, the degree that the waist band of the lower body garment 22 is extended can be easily and quickly changed to suit the wearer.

The tab portion 30 extends outward from the belt loop portion 32 and is integral with the belt loop portion 32. The tab portion is located intermediate the buckle mechanism 36 at the first free end of the belt loop portion and the tongue 38 at the second free end of the belt loop portion. The tab portion 30 is preferably formed from the same strip or band of material from which the belt loop portion is formed. As shown in FIGS. 1 and 2, the tab portion 30 is typically formed by doubling over the strip or band of material used to form the belt loop portion 32 intermediate the free ends of the belt loop portion 32. The juncture of the tab portion 30 and the first and second free ends of the loop portion is defined by a rivet, stitching or other means for securing the double layers of the tab portion together.

While the buckle mechanism 36 on the first free end of the belt loop portion 32 can be any buckle mechanism for releasably, fastening or securing the tongue 38 of the belt loop portion in place after the belt loop portion has been adjusted to form a belt loop of the desired size to comfortably extend the waist band of the lower body garment 22 to suit the wearer, the preferred buckle mechanism 36 is shown in FIGS. 1, 2, 4 and 5. In the preferred embodiment, the buckle mechanism 36 has a prong 40 which is passed through any one of a series 42 of closely spaced apertures 44 in the tongue 38 of the belt loop portion to adjustably, secure the free ends of the belt loop portion together. The buckle mechanism 36 is preferably located adjacent the juncture of the first free end of the belt loop portion 32 and the tab portion 30. The series 42 of closely spaced apertures 44 in the tongue 38 of the second free end of the belt loop portion preferably begins adjacent the juncture of the second free end of the belt loop portion 32 and the tab portion 30 and extends for substantially the entire length of the second free end of the belt loop portion. This enables the detachable waist band extender 20 to extend the waist band of the lower body garment 22 from a very small degree to a very large degree. In addition, the apertures 44 in the series of apertures 42 are preferably spaced on one half inch centers or less. Since the securement of the tongue 38 of the second free end in the buckle mechanism 36 of the first free end forms a belt loop, changing the prong 40 from one aperture 44 of the series to an adjacent aperture 44 of the series causes an effective length change in the extension of the waist band of the lower body garment 22 by the detachable waist band extender 20 equal to one-half the distance on centers of the apertures 44. Thus, with the apertures 44 spaced on one half inch centers, changing the prong to an adjacent aperture increases or decreases the extension of the waist band of the lower body garment by one quarter of an inch. If the apertures were spaced on quarter inch centers, changing the prong to an adjacent aperture would increase or decrease the extension of the waist band by one eighth of an inch. Thus, the detachable waist band extender 20 enables the wearer to adjust the extension of the waist band from a very small degree to a very large degree and to accurately adjust the extension of the waist band between these extremes to comfortably fit the waist measurement of the wearer.

The band or strap of the waist band extender 20 is preferably made of an inextensible material or a substantially inextensible material, such as leather or seat belt material. The tab portion 30 of detachable waist band extender is typically about an inch and one half long with the button hole 34 intermediate and typically substantially centered between the ends of the tab portion. The buckle mechanism 36 is adjacent the juncture of the first free end of the belt loop portion and the tab portion and the tongue 38 of the second free end of the belt loop portion typically extends about six to twelve inches from its juncture with the tab portion 30. However, if the lower body garment 22 is constructed so that the first and second sides of the fly opening 24 in the waist band of the lower body garment 22 can be spaced further apart than normal fly openings, the length of the tongue 38 of the belt loop portion can be longer than stated above to accommodate the garment.

Turning now to FIGS. 3–5, the application of the detachable waist band extender 20 to a lower body garment 22 will now be described in greater detail. As shown in FIG. 3, the fly opening 24 extends downward into the lower body garment 22 from an upper edge of the waist band of the lower body garment 22 and has a fly button 26 adjacent and on a first side of the fly opening and a button hole 28 adjacent and on a second side of the fly opening for receiving the button 26 to secure the fly opening together at the waist band under normal wearing conditions.

The detachable waist band extender 20 of the present invention is typically applied to the waist band of the lower body garment 22 by fastening the tab portion 30 to the waist band button 26 on one side of the fly opening 24. Then, as shown in FIG. 4, the tongue 38 of the belt loop portion 32 of the detachable waist band extender is passed through the waist band button hole 28 on the opposite side of the fly opening 24. The tongue 38 is then inserted into the buckle mechanism 36 and secured in place, as shown in FIG. 5, by passing the prong 40 through one of the apertures 44 at the proper setting to extend the waist band of the lower body garment 22 a selected amount to comfortably fit the wearer.

When the wearer desires to remove the lower body garment 22, the wearer merely unfastens the tab portion 30 from the waist band button 26. Once the detachable waist band extender 20 has been properly adjusted and the tongue 38 secured in place in the buckle mechanism 36, the detachable waist band extender can be left in place temporarily so that the wearer can remove and put on the garment by merely unfastening and refastening the tab portion 30 of the detachable waist band extender to the waist band button 26. When the lower body garment 22 is put back on or while the lower body garment is being worn, the wearer can also make slight to large adjustments to the detachable waist band extender 20 to accommodate any changes in the waist line measurement of the wearer so that the garment continues to fit comfortably.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A detachable waist band extender for temporarily extending the waist band of a lower body garment, having a certain waist dimension, to enable an individual to wear the garment when the waist measurement of the individual exceeds the waist dimension of the garment wherein the garment has a fly opening extending downward from an upper edge of a waist band of the garment with a button on a first side of the fly opening and a button hole on a second side of the fly opening for receiving the button to close the fly opening, said detachable waist band extender comprising:

a tab portion having a button hole therein for receiving the garment button to secure said detachable waist band extender to the first side of the fly opening;

a belt loop portion for securing said detachable waist band extender to the second side of the fly opening; said belt loop portion being integral with said tab portion and comprising a strap having a first free end with a buckle means and a second free end with a tongue means for adjustably securing said second free end to said buckle means to vary an effective length of said belt loop portion whereby said detachable waist band extender can be adjusted to an appropriate length required to secure the first and second sides of the garment fly together; said tongue means having a width no greater than a largest dimension of said garment button hole whereby said tongue means can be passed through the garment button hole and adjustably secured to said buckle means of said first free end to join said first and second free ends of said belt loop portion together and the first and second sides of the garment fly opening together; and said tab portion extending outward from said belt loop portion of said detachable waist band extender intermediate said buckle means of said first free end and said tongue means of said second free end of said belt loop portion.

2. The detachable waist band extender of claim 1, wherein: said tongue means of said second free end of said belt loop portion has a plurality of apertures therein; and said buckle means of said first free end has a prong means which is selectively received within one of said plurality of apertures to secure said free ends of said belt loop portion together.

3. The detachable waist band extender of claim 2, wherein: said tab portion and said belt loop portion of said waist band extender are made of an inextensible material.

4. The detachable waist band extender of claim 2, wherein; said buckle means is located a juncture of said tab means and said belt loop portion; and said plurality of apertures extend for substantially the entire length of said tongue means.

5. The detachable waist band extender of claim 2, wherein: said apertures are spaced on one half inch centers or less.

6. A waist band extended garment, comprising:

a lower body garment having a permanent waist band of a certain dimension along the upper portion of said garment which is to be worn about the waist of an individual; said garment having a fly opening extending downward from an upper edge of said waist band of said garment; said garment having a button on a first side of said fly opening and a button hole on a second side of said fly opening for receiving said button to close said fly opening;

a detachable waist band extender comprising a tab portion having a button hole therein; said button being fastened to said button hole of said tab portion to secure said detachable waist band extender to said first side of said fly opening; a belt loop portion for securing said detachable waist band extender to said second side of said fly opening; said belt loop portion being integral with said tab portion and comprising a strap having a first free end with a buckle means and a second free end with a tongue means for adjustably securing said second free end to said buckle means to vary an effective length of said belt loop portion whereby said detachable waist band extender can be adjusted to an appropriate length required to secure said first and said second sides of said fly opening together in a spaced relationship; said tongue means having a width no greater than a largest dimension of said button hole whereby said tongue means can be passed through said garment button hole and adjustably secured to said buckle means of said first free end to join said first and said second free ends together; said tongue means passing through said garment button hole and being secured to said buckle means to join said first and said second sides of said fly opening together in said spaced relationship; and said tab portion extending outward from said belt loop portion of said detachable waist band extender intermediate said buckle means of said first free end and said tongue means of said second free end of said belt loop portion.

7. The waist band extended garment of claim 6, wherein: said tab portion and said belt loop portion of said detachable waist band extender are made of an inextensible material; said tongue means of said second free end of said belt loop portion has a plurality of apertures therein; and said buckle means of said first free end of said belt loop portion has a prong means which is selectively received within one of said plurality of apertures to secure said free ends of said belt loop portion together.

8. The waist band extended garment of claim 6, wherein: said buckle means is located adjacent a juncture of skid tab means and said belt loop portion; and said plurality of apertures extend for substantially the entire length of said tongue means.

9. The waist band extended garment of claim 7, wherein: said apertures are spaced on one half inch centers or less.

* * * * *